US010228645B2

(12) United States Patent
Hikichi

(10) Patent No.: US 10,228,645 B2
(45) Date of Patent: Mar. 12, 2019

(54) IMAGE FORMING APPARATUS, POWER CONTROL METHOD OF IMAGE FORMING APPARATUS, AND STORAGE MEDIUM

(71) Applicant: CANON KABUSHIKI KAISHA, Tokyo (JP)

(72) Inventor: Atsushi Hikichi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/645,048

(22) Filed: Jul. 10, 2017

(65) Prior Publication Data

US 2018/0017914 A1 Jan. 18, 2018

(30) Foreign Application Priority Data

Jul. 14, 2016 (JP) ..... 2016-139384

(51) Int. Cl.
*G03G 15/00* (2006.01)

(52) U.S. Cl.
CPC ..... *G03G 15/5004* (2013.01); *G03G 15/80* (2013.01)

(58) Field of Classification Search
CPC . G03G 15/5004; G03G 15/80; H04N 1/00891
See application file for complete search history.

(56) References Cited

U.S. PATENT DOCUMENTS 7,389,431 B2 6/2008 Ohara
2003/0219274 A1* 11/2003 Hirose ..... G03G 21/206 399/92
2006/0221368 A1* 10/2006 Higuchi ..... G06F 3/1204 358/1.13
2006/0285867 A1* 12/2006 Takahashi ..... G03G 15/80 399/70
2016/0006895 A1 1/2016 Hikichi

FOREIGN PATENT DOCUMENTS

JP 2006-025212 A 1/2006

OTHER PUBLICATIONS

U.S. Appl. No. 15/661,229, filed Jul. 27, 2017, Inventor: Atsushi Hikichi.

* cited by examiner

*Primary Examiner* — Gregory H Curran
(74) *Attorney, Agent, or Firm* — Venable LLP

(57) ABSTRACT

An image forming apparatus includes: a printing unit for making printing on a print medium; a communicating unit for communicating with an external apparatus; a controlling unit for controlling the image forming apparatus; a storing unit for storing print data which is used by the printing unit; and a power controlling unit for transferring the image forming apparatus to a power saving state in which power supply to the controlling unit and the storing unit is stopped. The communicating unit outputs a first signal to the power controlling unit in a case where a destination port number of data received from the external apparatus in the power saving state is a predetermined port number, and the power controlling unit supplies power at least to the storing unit in response to input of the first signal.

14 Claims, 7 Drawing Sheets

IMAGE FORMING APPARATUS, POWER CONTROL METHOD OF IMAGE FORMING APPARATUS, AND STORAGE MEDIUM

BACKGROUND OF THE INVENTION

Field of the Invention

The present invention relates to an image forming apparatus which switches between on/off of power supply to a storage device at the time of resuming from sleep, a power control method of the image forming apparatus, and a storage medium.

Description of the Related Art

Among image forming apparatuses that are operable by switching between a normal power state and a power saving state, there has been known an image forming apparatus that resumes from sleep, that is, from the power saving state to the normal power state, in a case where a print job is received from an external apparatus. Among such type of image forming apparatus, there is proposed an image forming apparatus which supplies power to a controller that controls the image forming apparatus and to a hard disk drive (hereinafter denoted as an "HDD") that is a storage device at the time of resuming from sleep (Japanese Patent Laid-open No. 2006-025212). The image forming apparatus disclosed in Japanese Patent Laid-open No. 2006-025212 stores print data generated by interpreting the print job in the HDD which has been resumed from sleep. The print data stored in the HDD is transmitted to a print device by the controller, which has also been resumed from sleep, and is printed on a sheet.

In addition to the image forming apparatus disclosed in Japanese Patent Laid-open No. 2006-025212, an image forming apparatus that supplies power only to a controller at the time of resuming from sleep is also proposed. In this type of image forming apparatus, the controller that has resumed from sleep determines whether to further supply power to the HDD, and if there is no need to activate the HDD, the power remains unsupplied to the HDD. This is because that there is a case where, depending on the type of job to be received from the external apparatus, the execution of the job can be accomplished only by a CPU and a RAM that are mounted in the controller and no access to the HDD is required. For example, in a case where a ping command based on an ICMP protocol is received from the external apparatus, the CPU only needs to generate ping response data to respond to the external apparatus within a specified time period, and there is no need to interpose the HDD.

SUMMARY OF THE INVENTION

The present invention has been made in consideration of the above problem to be solved, and an object of the present invention is to suppress wasteful power consumption and the wearing out of a storage device while reducing the period from resume from sleep to the completion of printing.

An image forming apparatus of the present invention includes: a printing unit for making printing on a print medium; a communicating unit for communicating with an external apparatus; a controlling unit for controlling the image forming apparatus; a storing unit for storing print data which is used by the printing unit; and a power controlling unit for transferring the image forming apparatus to a power saving state in which power supply to the controlling unit and the storing unit is stopped. The communicating unit outputs a first signal to the power controlling unit in a case where a destination port number of data received from the external apparatus in the power saving state is a predetermined port number, and the power controlling unit supplies power at least to the storing unit in response to input of the first signal.

Further features of the present invention will become apparent from the following description of exemplary embodiments with reference to the attached drawings.

DESCRIPTION OF THE EMBODIMENTS

The image forming apparatus disclosed in Japanese Patent Laid-open No. 2006-025212 supplies power to the HDD at all time to restart the operation of the HDD upon the resume from sleep. For this reason, even in a case where no access to the HDD is required, the power is supplied to the HDD, causing wasteful power consumption and the wearing out of the HDD.

Further, in the image forming apparatus disclosed in Japanese Patent Laid-open No. 2006-025212, the controller that has been resumed from sleep determines whether the power supply to the HDD is required. For this reason, in a case where a print job is received from the external apparatus, timing at which print data is stored in the HDD is delayed, and a period from the resume from sleep to the completion of printing a first page is longer.

Hereinafter, embodiments to carry out the present invention will be explained with reference to the drawings. It should be noted that constituent elements described in the embodiments are mere examples, and thus, the scope of the present invention is not directed to limiting only to those constituent elements.

First Embodiment (System Configuration)

Figure 1:
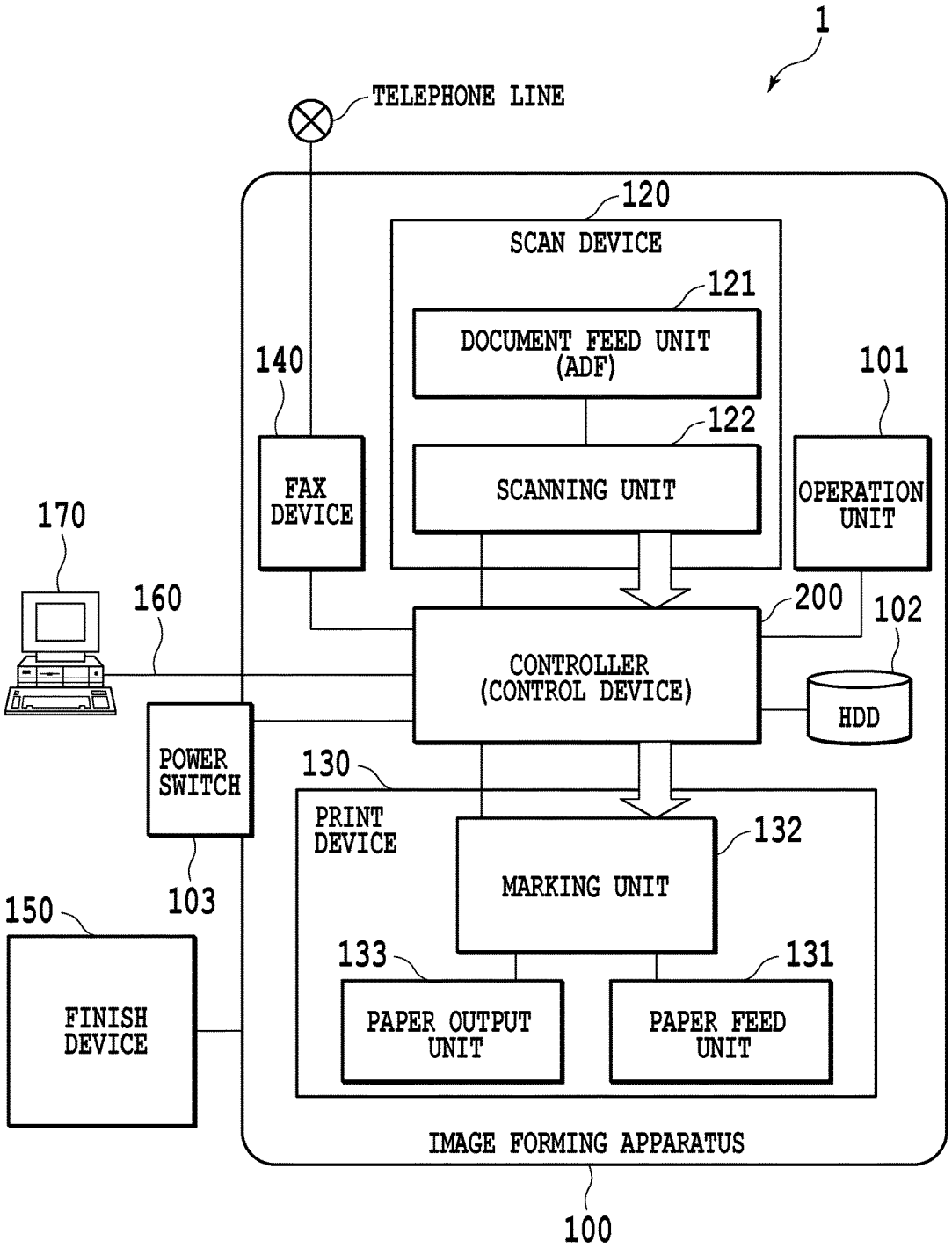
FIG. 1 is an entire configuration diagram of an image forming system according to a first embodiment.

FIG. 1 is a block diagram illustrating an entire configuration of an image forming system 1 according to the present embodiment. In the present embodiment, an example of a case where an image forming apparatus 100 for realizing the image forming system 1 is a multifunction machine including a printing function, a scanning function, and a data communication function will be explained.

In FIG. 1, the image forming apparatus 100 is configured to receive, via a LAN 160, various data from a computer 170, that is, an external apparatus. According to the present embodiment, as the details will be described later, data is transmitted from the computer 170, which is the external apparatus to the image forming apparatus 100 in a packet format. It should be noted that the number of computers to be connected to the image forming apparatus 100 may be two or more. A scan device 120 optically reads a document to convert it into a digital image. A print device 130 outputs the digital image on a print medium such as a cut sheet. An operation unit 101 includes a touch panel and a hardkey for accepting user's setting to the image forming apparatus 100 and for displaying setting information and the state of processing. An HDD 102 is a storage device for storing digital images, control programs, and the like. A facsimile device 140 transmits/receives digital images to/from another facsimile device at a remote place via a telephone line. A controller (control device) 200 controls the action of the image forming apparatus 100 and is connected to the scan device 120, print device 130, operation unit 101, HDD 102, and facsimile device 140. The controller 200 activates modules by giving instructions to each of the modules.

The image forming apparatus 100 accepts input/output of digital images, jobs, instruction data (commands), and the like with respect to the computer 170 via the LAN 160. The scan device 120 mainly includes an auto document feeder (ADF) scheme of a document feed unit 121 and a scanning unit 122 which converts the document into a digital image by optical scanning. The digital image converted from the document by the optical scanning is transmitted from the scan device 120 to the controller 200.

The print device 130 includes a paper feed unit 131 for feeding paper one by one from a bundle of cut sheets at an appropriate timing, a marking unit 132 for making printing on the fed cut sheets, and a paper output unit 133 for outputting the printed cut sheets. A finish device 150 performs processing such as sorting, stapling, punching, and cutting with respect to the cut sheets outputted from the paper output unit 133.

The image forming apparatus 100 retains a power switch 103 connected to the controller 200. In a case where the power switch 103 is turned on, the power is supplied at least to a power supply control unit 303, an operation unit 101, and a part of a main board in the controller 200, as will be described later. In the present embodiment, even if the power switch 103 is switched from on to off, the power supply to each of the modules does not stop immediately. The power supply is stopped for the part other than a part that would be needed to turn on the power switch 103 after stopping the drive of software and hardware included in the image forming apparatus 100.

The operation unit 101 is connected to the controller 200 inside the image forming apparatus 100, and includes an LCD touch panel, a power saving button, a copy button, a cancel button, a reset button, a ten key, and a user mode key. According to the present embodiment, the operation unit 101 provides a user interface for operating the image forming system 1.

(Specific Configuration of Controller)

Figure 2:
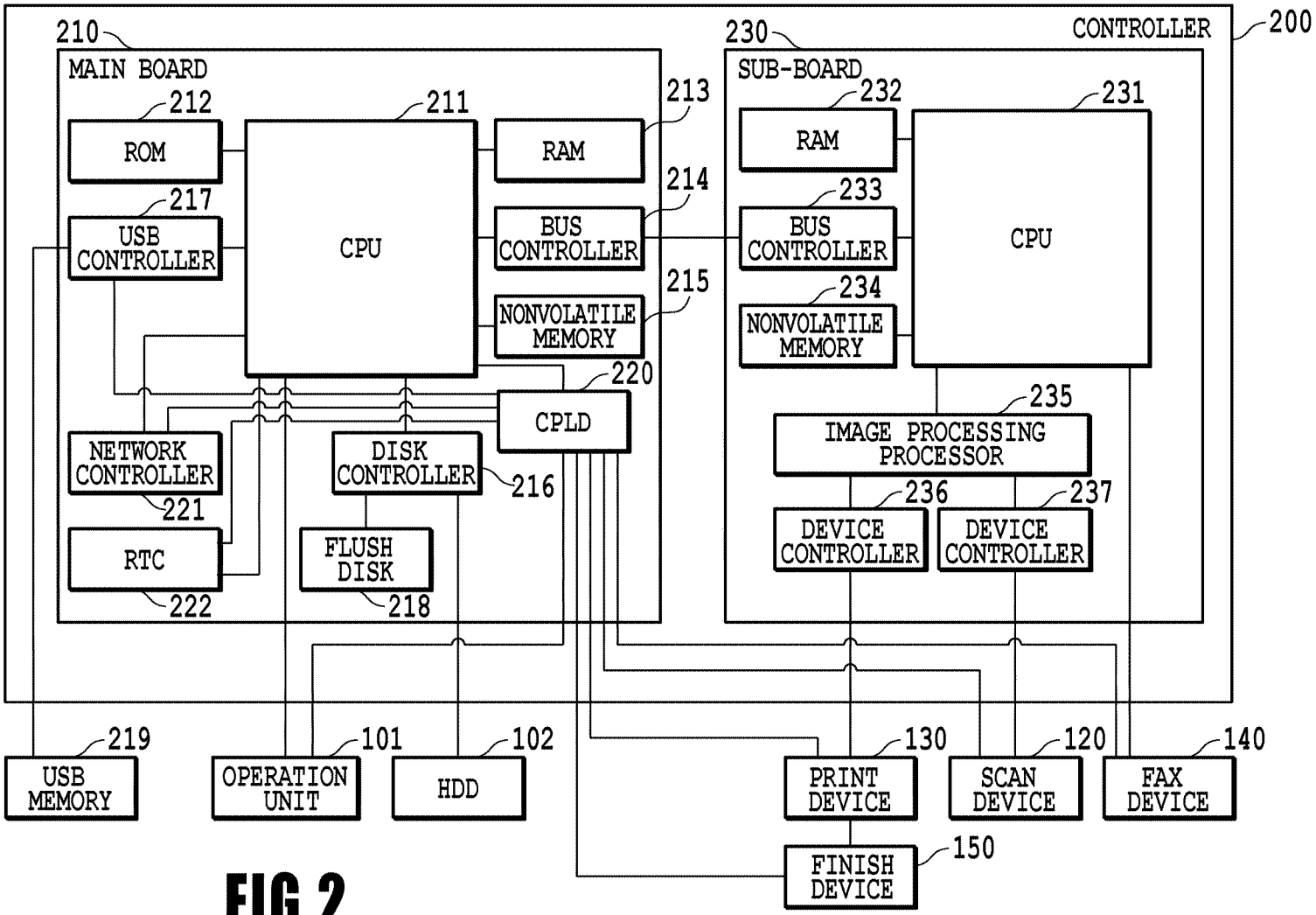
FIG. 2 is a block diagram showing a specific configuration of a controller according to the first embodiment.

FIG. 2 is a block diagram showing a specific configuration of the controller 200 and peripheral devices according to the present embodiment. The controller 200 includes a main board 210 and a sub-board 230. The main board 210 is a so-called CPU system for general purpose use. The main board 210 mainly includes a CPU 211 that controls the entire main board 210, a ROM 212 that stores a boot program, and a RAM 213 that is used as a work area of the CPU 211. A bus controller 214 has a bridge function to an external bus of the main board 210. A nonvolatile memory 215 is a storage area that does not eliminate retained data even in a power-off state in which the power is not supplied. Further, the main board 210 includes a disk controller 216 and a USB controller 217. The disk controller 216 controls storage devices such as the HDD 102 and a flash disk 218 having relatively small capacity which is made of a semiconductor device. Through these interfaces, the main board 210 is connected to external devices such as the HDD 102 and a USB memory 219.

Furthermore, in the main board 210, the CPU 211 is connected to a CPLD 220 that controls interruption from each of the modules included in the main board 210 and power supply to each of the modules included therein. Further, the main board 210 includes the USB controller 217, a network controller 221, and a real time clock (hereinafter denoted as an "RTC") 222 which are connected to both the CPU 211 and the CPLD 220. In the present embodiment, the facsimile device 140, the operation unit 101 having a software switch, the scan device 120 having various sensors, the print device 130, and the finish device 150, which are external devices of the controller 200, are also connected to the CPLD 220.

The sub-board 230 is a CPU system smaller than the main board 210 and is hardware specific to image processing. The sub-board 230 mainly includes a CPU 231 that controls the entire sub-board 230 and a RAM 232 that is used as a work area of the CPU 231. A bus controller 233 has a bridge function to an external bus. A nonvolatile memory 234 is a storage area that does not eliminate retained data even in a power-off state in which the power is not supplied. An image processing processor 235 performs image processing of inputted digital images. The image processing processor 235 delivers digital images to be processed for image processing to the print device 130, which is an external device of the controller 200, through a device controller 236. Similarly, the image processing processor 235 delivers digital images to be processed for image processing to the scan device 120, which is an external device of the controller 200, through a device controller 237. A cut sheet outputted from the print device 130 is processed in the finish device 150. As to the facsimile device 140, no device controller exists and the CPU 231 directly controls the facsimile device 140.

The configuration block diagram of the controller 200 and peripheral devices shown in FIG. 2 is simplified. For example, the CPU 211 and the CPU 231 actually provide multiple pieces of peripheral hardware such as a chipset, a bus bridge, and a clock generator, but these are omitted in FIG. 2. However, the configuration block diagram shown in FIG. 2 does not limit the technical scope of the present invention.

As to the action of the controller 200, an explanation will be given on an example in which the print device 130 copies an image on a cut sheet. Once a copy instruction inputted by user's operation is accepted from the operation unit 101, the CPU 211 sends an image read command to the scan device 120 through the CPU 231. The scan device 120 acquires a digital image by optically scanning a paper document in accordance with the received image read command. The scan device 120 further inputs the acquired digital image to the image processing processor 235 through the device controller 237. The image processing processor 235 performs direct memory access (DMA) transfer to the RAM 232 through the CPU 231 to temporarily store the acquired digital image in the RAM 232.

The CPU 211 then confirms that the digital image is stored for a certain amount or full amount in the RAM 232, and sends an image print command to the print device 130 through the CPU 231. At this time, the CPU 231 notifies the image processing processor 235 of an address of a destination to store the digital image in the RAM 232. The digital image stored in the RAM 232 is transmitted to the print device 130 through the processing processor 235 and device controller 236 in accordance with a synchronization signal sent by the print device 130. The print device 130 prints an image on the cut sheet based on the transmitted digital image. In a case where a plurality of copies of images are to be printed, the CPU 211 reads out the digital image stored in the RAM 232 and stores it in the HDD 102. In printing a second copy and further on, the CPU 211 transmits the digital image to the print device 130 from the HDD 102 and the RAM 232, instead of acquiring the digital image from the scan device 120.

(Configuration of Power Supply)

Figure 3:
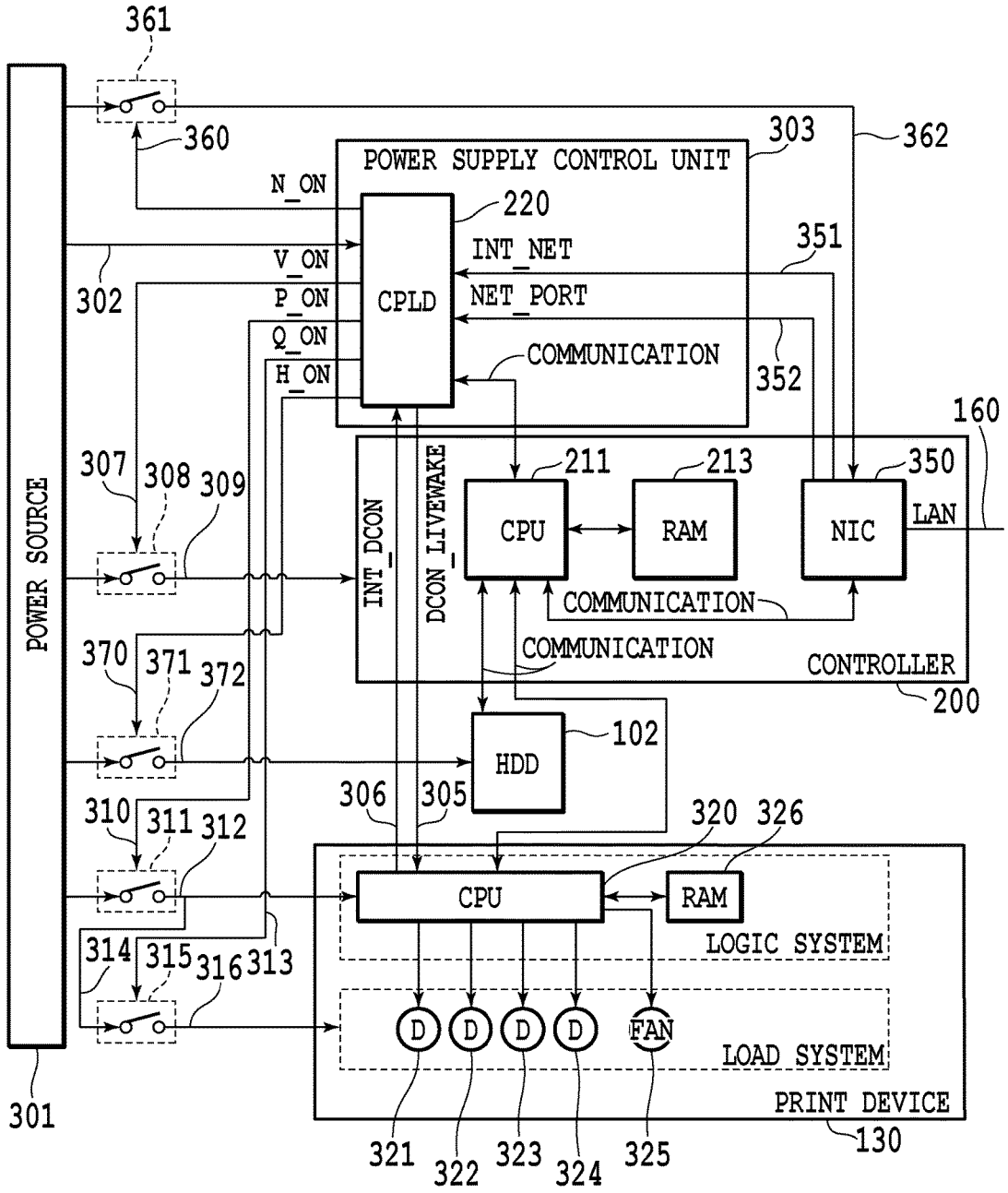
FIG. 3 is a block diagram showing a configuration of power supply of an image forming apparatus according to the first embodiment.

FIG. 3 is a block diagram illustrating a configuration of power supply of the image forming apparatus 100 according to the present embodiment. Hereinafter, with reference to FIG. 3, the configuration of the power supply of the image forming apparatus 100 will be explained.

As shown in FIG. 3, the power supply control unit 303 constantly supplies power from a power source 301 via a power supply line 302. However, in a case where the image forming apparatus 100 is powered off, the power consumption of the image forming apparatus 100 is very low, and thus, the power is only supplied to the power supply control unit 303 via the power supply line 302 to perform power saving control over the image forming apparatus 100. As such, regardless of whether the image forming apparatus 100 is in a normal power state or a power saving state, a power supply system that supplies power from the power source 301 is denoted as "night power supply" in the present specification and in FIG. 3. Meanwhile, a power supply system that supplies power from the power source 301 if the image forming apparatus 100 is in the normal power state and that does not supply power from the power source 301 if in the power saving state is denoted as "non-night power supply." It should be noted that, in the present embodiment, the normal power state refers to a power state in which power required for each of the modules for printing is supplied, while the power saving state refers to a power state in which the amount of power consumption of the image forming apparatus 100 is smaller than that in the normal power state.

A complex programmable logic device (CPLD) 220 is programmed beforehand so as to execute actions described below. Specifically, in response to the input of an IO signal V_ON 307, which is a power supply control signal, a relay switch 308 is switched. In response to the switching of the relay switch 308, the power supply from the power source 301 to the controller 200 via a power supply line 309, which is a power supply line, is controlled.

Further, in response to the input of an IO signal P_ON 310, which is a power supply control signal, a relay switch 311 is switched. In response to the switching of the relay switch 311, the power supply from the power source 301 to a logic-system circuit of the print device 130 via a power supply line 312, that is, a power supply line, is controlled.

Moreover, in response to the input of an IO signal Q_ON 313, which is a sub-signal of the power supply control signal, the IO signal P_ON 310, a relay switch 315 is switched. In response to the switching of the relay switch 315, the power supply from the power source 301 to load-system devices of the print device 130 via a power supply line 316, which is a sub-line of the power supply line 312, is controlled. The above-described power supply line 316 may not necessarily be a sub-line of the power supply line 312, but may be directly connected to the power source 301. Also, the relay switch 315 is controlled in accordance with a signal inputted from the CPLD 220, but may be controlled in accordance with a signal inputted from a CPU 320 and the like. The CPLD 220 of the present embodiment outputs predetermined IO signals in response to instructions given from the CPU 211 and a NIC 350.

Out of the IO signals outputted by the CPLD 220, a DCON_LIVEWAKE signal 305 is inputted to the CPU 320 of the print device 130. Once power insertion to the print device 130 is started in a state in which the DCON_LIVEWAKE signal 305 is asserted, the print device 130 activates without making specific action. Hence, the print device 130 can activate calmly compared to the normal activation. As to the above specific actions, the rotation of a motor, a roller, a polygon, and the like, temperature adjustment for drums D 321, 322, 323, and 324, and heat exhaust by using a fan 325 are exemplified. The scan device 120 can also be controlled in accordance with a signal inputted from the CPLD 220. However, since the specific content of control is identical to the case of controlling the print device 130, its explanation will be omitted.

As shown in FIG. 3, power supply from the power source 301 to each of the modules (the controller 200, the power supply control unit 303, and the print device 130) is achieved by configuring, for example, the relay switch 308 to have a dual system. In a case where the image forming apparatus 100 is in the power saving state, only a relay switch that is connected to modules in which their power is to be turned off is turned off while the other relay switch is turned on so as to achieve power supply control by using the configuration of the dual-system relay switch. In a case where the image forming apparatus 100 is in a power-off state, the relay switch connected to each of the modules and the other relay switch are to be turned off. As described above, in the case of configuring the relay switch 308 to have the dual system, a power supply control signal is not a binary, but a multivalue in accordance with an energizing state. Due to such a configuration, the image forming apparatus 100 of the present embodiment can achieve power control for transferring to each of the power states such as the power saving state and the power-off state.

To be more specific, in response to the input of an IO signal N_ON 360, which is a power supply control signal inputted by the CPLD 220, a relay switch 361 is switched. In response to the switching of the relay switch 361, power supply from the power source 301 to a network interface card (NIC) 350 via a power supply line 362 is controlled. In the image forming apparatus 100 of the present embodiment, among the CPU 211, the RAM 213, and the NIC 350 included in the controller 200, only the NIC 350 receives power supply from an independent power supply line 362. Unlike the other non-night power supplies, the NIC 350 is connected to the night power supply system, and therefore, even if power supply to the controller 200 is limited in the power saving state, the NIC 350 can receive the power supply via the power supply line 362. As a result, even if the image forming apparatus 100 is in the power saving state, the NIC 350 can receive data transmitted from an external apparatus via a network. Further, in the power-off state, unless a setting such as a "Wake On LAN" is enabled, the power source 301 does not supply power to the NIC 350 via the power supply line 362. The power supply line 362 via the relay switch 361 constantly supplies power to the NIC 350 other than in the power-off state.

Further, in response to the input of an IO signal H_ON 370, which is a power supply control signal, a relay switch 371 is switched. In response to the switching of the relay switch 371, power supply from the power source 301 to the HDD 102 via a power supply line 372 is controlled. It should be noted that, in FIG. 2, data is exchanged between the CPU 211 and the HDD 102 as well as the CPU 211 and the flash disk 218 via the disk controller 216, but such a configuration is omitted in FIG. 3.

(Power Supply Monitoring 1 by Power Supply Control Unit: Power Supply at Startup)

Next, procedures of power supply at the startup of the image forming apparatus 100 will be explained. In a case of using the image forming apparatus 100, the power switch 103 is inputted to be turned on by an operator. Once the power switch 103 is inputted to be turned on, the power supply control unit 303 detects, in response to a signal inputted from the power supply line 302, that the power switch 103 is inputted to be turned on.

The CPLD 220 issues the IO signal V_ON 307 and the IO signal P_ON 310 to turn on each of the relay switches 308 and 311. Once the relay switches 308 and 311 are turned on, the power source 301 starts supplying power to the entire image forming apparatus 100 via each of the power supply lines. Furthermore, once the power switch 103 is turned on, the power supply control unit 303 controls power supply to each of the modules included in the image forming apparatus 100. Specifically, the power is controlled to be supplied from the power source 301 to each of the controller 200, print device 130, and scan device 120 via DC power supply lines. In response to the start of the power supply, the print device 130 and the scan device 120 starts initialization of each of their CPUs.

Once the power supply to the controller 200 starts, the CPU 211 starts initialization of hardware. In such initialization of hardware, initialization of a register, initialization of an interruption, registration of a device driver at the start of a kernel, initialization of the operation unit 101, and the like are executed.

Once the initialization of hardware ends, the CPU 211 executes initialization of software. In the initialization of software, a call for an initialization routine for each library, the startup of processes (threads), the startup of each of services for transmitting/receiving data to/from an external apparatus, rendering on the operation unit 101, and the like are executed. Once the initialization of hardware and software is accomplished by the CPU 211, the image forming apparatus 100 transfers to the normal power state.

(Power Supply Monitoring 2 by Power Supply Control Unit: Power Supply in Normal Power State)

Next, procedures of power supply in a case where the print device 130 and the scan device 120 are not in use while the image forming apparatus 100 is in the normal power state will be explained.

According to the present embodiment, the normal power state does not only refer to a state where power is supplied to all units in the image forming apparatus 100, but also includes cases where power is not supplied to the print device 130 after the lapse of predetermined time from the completion of the last printing and where power is not supplied to the scan device 120 after detecting user's absence.

In addition, the normal power state also includes a case where power is supplied only to some of the devices within the units such as the motor or the polygon of the print device 130 and a sensor for detecting a home position in the scan device 120. Due to such configurations, a time period required to perform printing by the print device 130 and a time period required to perform reading by the scan device 120 can be reduced.

(Power Supply Monitoring 3 by Power Supply Control Unit: Power Supply at the Time of Printing)

Next, procedures of power supply in a case where the image forming apparatus 100 performs printing will be explained. The CPU 211 of the controller 200 receives printing instruction data which instructs the print device 130 to perform printing from the computer 170 via the LAN 160. Hereinafter, the printing instruction data is also denoted as a "print job".

The CPU 211 stores the received print job in the RAM 213. The CPU 211 analyzes the print job stored in the RAM 213. The CPU 211 analyzes the print job described in Page Description Language (PDL), for example, to generate a digital image such as a bitmap image. The generated digital image is stored in the HDD 102, which is a storage device, or stored in the RAM 213 again.

The CPU 211 notifies the CPLD 220 of the reception of the print job and controls to cause the CPLD 220 to issue the IO signal P_ON 310. Once the IO signal P_ON 310 is inputted, the relay switch 311 is switched and power is supplied from the power source 301 to the print device 130 via the power supply line 312. Once the print device 130 becomes operable, the CPU 211 causes the print device 130 to perform printing in accordance with the analyzed print data. To be more specific, the CPU 211 transmits a digital image to be printed through the route of the RAM 213, the bus controller 214, and the bus controller 233 and CPU 231 in the sub-board 230. Further, the digital image is transmitted to the print device 130 through the image processing processor 235 and the device controller 236. The print device 130 performs printing in accordance with the received digital image. Once the printing is completed, the result of performing printing is notified to the CPU 211. Once the completion of the printing is detected, the CPU 211 causes the CPLD 220 to stop the IO signal P_ON 310. Once the IO signal P_ON 310 stops, the relay switch 311 is tuned off and power supply from the power source 301 to the print device 130 stops.

(Power Supply Monitoring 4 by Power Supply Control Unit: Power Supply at the Time of Transferring to Sleep)

Next, procedures of processing of transferring to sleep in which the image forming apparatus 100 transits to the power saving state will be explained. If a state in which the image forming apparatus 100 is not in use continues for a certain time period, the CPU 211 starts sleep-transfer processing which causes the controller 200 to make transition to the power saving state. The CPU 211 notifies the power supply control unit 303 that the controller 200 transits to the power saving state and controls to cause the CPLD 220 to stop the IO signal V_ON 307. Once the IO signal V_ON 307 stops, the relay switch 308 is switched and power supply from the power source 301 to the controller 200 is stopped. It should be noted that, as described above, only the relay switch that is connected to modules in which their power is to be turned off is turned off while the other relay switch is turned on so as to achieve the configuration of the dual-system relay switch.

(Power Supply Monitoring 5 by Power Supply Control Unit: Power Supply in Power Saving State)

Next, procedures of power supply in a case where the image forming apparatus 100 is in the power saving state will be explained. The power saving state refers to a state in which the image forming apparatus 100 can transit to the normal power state in shorter time than usual while suppressing the amount of power consumption. In the present embodiment, the image forming apparatus 100 transits to the power saving state in cases, for example, where a state in which a user does not input any operation continues for a certain time period, where a user presses the power saving button (not shown) of the operation unit 101, and where a preset time has arrived. In the present embodiment, even if the image forming apparatus 100 is in the power saving state, power is supplied to the RAM 213, the USB controller 217, the network controller 221, the RTC 222, and the like in the controller 200. Further, in the present embodiment, power is also supplied to the operation unit 101 (the power saving button), the facsimile device 140, and various sensors. However, a resume factor which triggers the image forming apparatus 100 to transit to the normal power state varies according to the performance and settings of the image forming apparatus 100, and therefore, a configuration regarding to which module the power is supplied in the power saving state is not limited to the above described configuration.

(Power Supply Monitoring 6 by Power Supply Control Unit: Power Supply at the Time of Resuming from Sleep)

Next, procedures of processing at the time of resuming from sleep in which the image forming apparatus 100 transfers to the normal power state will be explained.

In a case where the image forming apparatus 100 is in the power saving state, the CPLD 220 accepts the input of a signal issued by each of the modules to detect the resume factor. In the present embodiment, the resume factors are exemplified that the network controller 221 has received a specific job transmitted via the LAN 160, that the RTC 222 has detected a predetermined time, and that the USB controller 217 has detected the insertion or removal of the USB memory 219. Then, the CPLD 220 notifies the CPU 211 of the resume factor, and upon receiving such notification, the CPU 211 executes processing to restart the operation of software, that is, the CPU 211 executes resume-from-sleep processing.

The CPU 211 that has been resumed from sleep notifies the power supply control unit 303 of its resume from sleep. The CPLD 220 issues the IO signal V_ON 307 and the IO signal P_ON 310 to turn on each of the relay switches 308 and 311. Once the relay switches 308 and 311 are turned on, the power source 301 starts supplying power to the controller 200 and the print device 130 via each of the power supply lines. Although not shown in FIG. 3, power supply control is also made for the scan device 120, like the print device 130, in accordance with a signal inputted from the CPLD 220. After the lapse of a certain time period after completion of printing by the print device 130, the image forming apparatus 100 transits to the power saving state again. The CPU 211 notifies the power supply control unit 303 of executing the sleep-transfer processing. The CPLD 220 stops the IO signal P_ON 310 to turn off the relay switch 311. Once the relay switch 311 is turned off, the power source 301 stops supplying power to the print device 130 other than the controller 200 via the power supply line 312.

Also, in a case where the network controller 221 receives specific instruction data transmitted via a network, the power supply control unit 303 controls power supply such that the CPU 211 resumes from sleep. Specifically, once the power supply control unit 303 detects receiving the specific instruction data, the CPLD 220 issues the IO signal V_ON 307 to turn on the relay switch 308. Once the relay switch 308 is turned on, the power source 301 starts supplying power to the controller 200 via the power supply line 309. As a result of starting the power supply to the controller 200, the CPU 211 resumes from the power saving state to the normal power state. In a case where instruction data transmitted via the network is not the printing instruction data, for example, the power supply control unit 303 may control not to supply power to the print device 130 and the scan device 120.

(NIC Resume-from-Sleep Processing)

Figure 4:
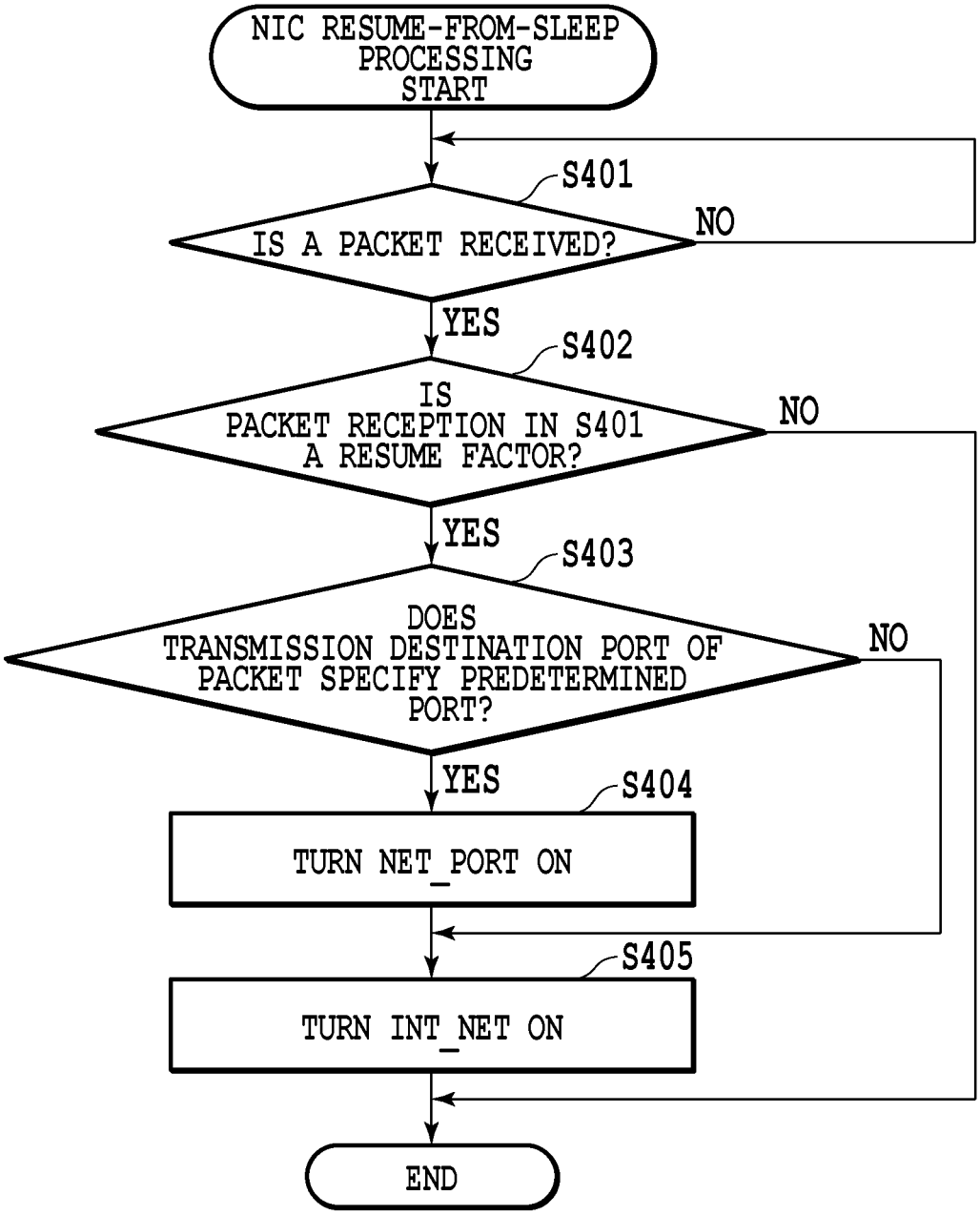
FIG. 4 is a flowchart showing steps of NIC resume-from-sleep processing according to the first embodiment.

NIC resume-from-sleep processing according to the present embodiment will be explained with reference to the flowchart of FIG. 4. It should be noted that, in the processing of the flowchart shown in FIG. 4, program codes stored in storage areas such as the RAM 213 and the HDD 102 are loaded and executed by the CPU 211. A symbol S denoted hereinafter refers to a step in flowcharts.

The image forming apparatus 100 of the present embodiment resumes, upon detecting the resume factor in the power saving state, from sleep, which is a transition from the power saving state to the normal power state. In the flowchart shown in FIG. 4, an example in which the NIC 350 receiving a specific packet is a resume factor is illustrated. It should be noted that, as described above, the NIC 350 also receives a job (instruction data) transmitted from the computer 170 (an external apparatus) in a packet format.

In S401, the NIC 350 determines whether a packet is received from the computer 170 that is, an external apparatus. In a case where the packet is received (YES in S401), the processing proceeds to S402. In a case where the packet is not received (NO in S401), the processing of S401 is repeated.

In S402, the NIC 350 determines whether the packet reception in S401 is a resume factor. In other words, the NIC 350 determines whether the packet received in S401 is a specific packet. In the present embodiment, the NIC 350 determines whether an IP address addressed to the image forming apparatus 100 or a WAKEUP character code is included in specified offset location in the packet received in S401.

Figure 5:
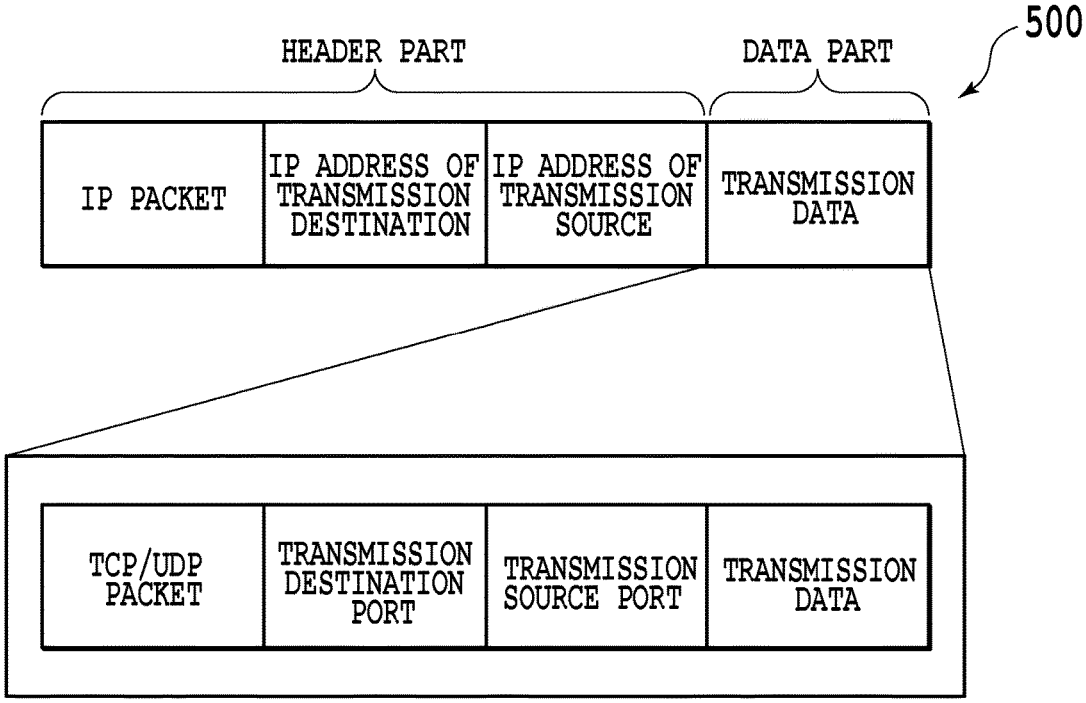
FIG. 5 is a schematic diagram of a packet according to the first embodiment.

According to the present embodiment, an example of a packet received by the image forming apparatus 100 will be explained with reference to the schematic diagram of FIG. 5. A packet 500 shown in FIG. 5 includes a header part and a data part. A magic number indicative of being an IP packet, an IP address of a transmission destination, an IP address of a transmission source are arranged in the header part of the packet 500, and transmission data is arranged in the data part. Further, the transmission data includes information indicating either one of TCP and UDP packets, a transmission destination port, a transmission source port, and transmission data.

In a case where the image forming apparatus 100 is in the power saving state, the NIC 350 determines whether an IP address of a transmission destination described in the header part is an IP address addressed to the image forming apparatus 100 (NIC 350). Alternatively, the NIC 350 determines whether a character code of "WAKEUP" is described in the data part. Based on the result of such determination, the NIC 350 determines whether the packet received in S401 is the specific packet.

Returning to FIG. 4 again, in a case where the packet reception in S401 is determined to be a resume factor (YES in S402), the processing proceeds to S403. In a case where the packet reception in S401 is determined not to be a resume factor (NO in S402), the process skips S403 through S405 and the processing of the flowchart ends.

In S403, the NIC 350 determines whether the transmission destination port of the packet received in S401 specifies a predetermined port. In the present embodiment, a RAW port for specifying RAW printing or an LPR port for specifying LPR printing, which is a protocol for executing printing via a network, is set as a predetermined port. To be more specific, the NIC 350 determines whether a transmission destination port number of the packet received in S401 specifies 9100 indicating the RAW port or 515 indicating the LPR port.

In a case where the transmission destination port of the received packet specifies a predetermined port (YES in S403), the NIC 350 turns on, in S404, a NET_PORT 352, which is an IO signal inputted to the CPLD 220 from the NIC 350. Meanwhile, in a case where the transmission destination port does not specify a predetermined port (NO in S403), the processing skips S404 and proceeds to S405.

In S405, the NIC 350 turns on an INT_NET 351, which is an IO signal inputted similarly to the CPLD 220 from the NIC 350. In S404 and S405, the NIC 350 notifies the CPLD 220 of the reception of the specific packet. In other words, the NIC 350 notifies the CPLD 220 of the detection of the resume factor. After the completion of S405, the processing of this flowchart ends.

(CPLD Resume-from-Sleep Processing)

Figure 6:
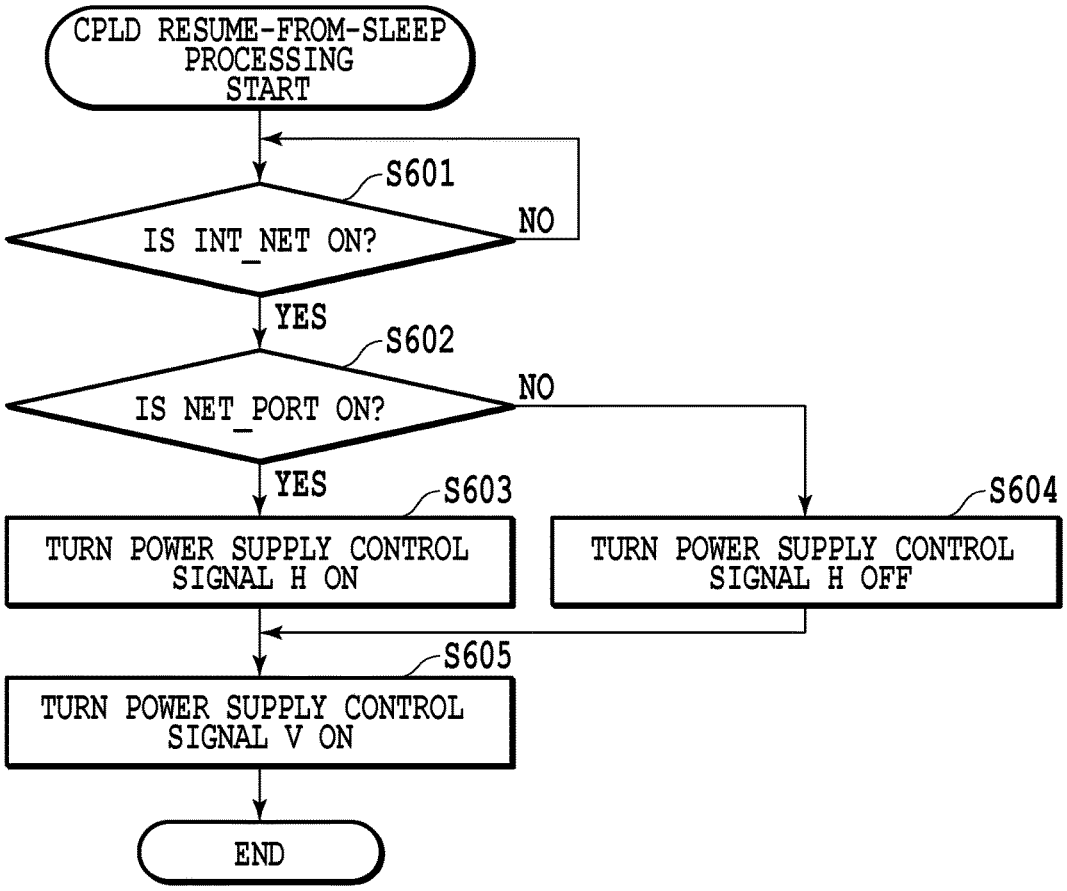
FIG. 6 is a flowchart showing steps of CPLD resume-from-sleep processing according to the first embodiment.

CPLD resume-from-sleep processing of the present embodiment will be explained with reference to the flowchart of FIG. 6.

In S601, the CPLD 220 determines whether INT_NET 351 is turned on or off. In a case where INT_NET 351 is on (YES in S601), the processing proceeds to S602. In a case where INT_NET 351 is off (NO in S601), the processing of S601 is repeated.

In S602, the CPLD 220 determines whether NET_PORT 352 is turned on or off. In a case where NET_PORT 352 is on (YES in S602), the processing proceeds to S603. In S603, the CPLD 220 issues the IO signal H_ON 370, that is, a power supply control signal. In response to the input of the IO signal H_ON 370, the relay switch 371 is switched. Then, in response to the switching of the relay switch 371, power is supplied from the power source 301 to the HDD 102 via the power supply line 372.

On the other hand, in a case where NET_PORT 352 is off (NO in S602), the processing proceeds to S604. In S604, the CPLD 220 keeps the IO signal H_ON 370, the power supply control signal, in a halt state. During the halt of the IO signal H_ON 370, the relay switch 371 is not switched and thus power is not supplied from the power source 301 to the HDD 102.

In S605, regardless of the state of NET_PORT 352, the CPLD 220 issues the IO signal V_ON 307, that is, a power supply control signal. In response to the input of the IO signal V_ON 307, the relay switch 308 is switched. Then, in response to the switching of the relay switch 308, power is supplied from the power source 301 to the controller 200 via the power supply line 309.

According to another embodiment, in the event of the resume from sleep, that is, from the power saving state to the normal power state, the CPLD 220 may constantly supply power to the HDD 102 as in a conventional manner regardless of whether NET_PORT 352 is turned on or off. In this case, the CPU 211 of the controller 200 can turn on a NET_PORT non-use register which sets whether to use a value for NET_PORT (on/off) outputted from the CPLD 220. As a result of such a configuration, in a case where the NET_PORT non-use register is set to be on upon starting power supply to the controller 200 (in S605), the CPLD 220 makes control so as to supply power to the HDD 102. After the completion of S605, the processing of this flowchart ends.

(Specific Examples of Instruction Data)

In the present embodiment, determination whether data received from an external apparatus is the instruction data requiring power supply to the HDD 102, which is a storage device, is made in accordance with whether the data is a print job instructing the image forming apparatus 100 to perform printing. This is because the HDD 102 needs to be in operation for storing print data generated from the print job. In other words, the controller 200 requires the existence of the HDD 102 in the event of the resume from sleep, that is, from the power saving state to the normal power state upon reception of the print job.

An explanation will be given below on specific examples of a print job instructing the image forming apparatus 100 to perform printing and instruction data that requires power supply to the HDD 102 in resuming from sleep. The image forming apparatus 100 of the present embodiment can accept, from the computer 170, a command requesting an access to a file retained by the HDD 102. For example, in a case where the computer 170 previews an image file retained by the HDD 102 of the image forming apparatus 100, a command of requesting read out of a file is transmitted from the computer 170 to the image forming apparatus 100 (NIC 350). In a case where the image forming apparatus 100 receives the command of requesting read out of the file from the computer 170, power supply to the HDD 102 is controlled so as to allow accessing to the image file retained by the HDD 102.

Alternatively, in a case where a command instructing to output document data is received while an IP-FAX function is in use, the image forming apparatus 100 makes control so as to supply power to the HDD 102. The IP-FAX function refers to a function that stores document data in the HDD 102, instead of the print device 130, by setting an output destination of the document data received by the facsimile device 140 via a phone line. In the case where the image forming apparatus 100 uses the IP-FAX function and receives the command instructing to output document data, the power is supplied to the HDD 102 so as to allow the document data to be stored in the HDD 102. As such, the type of job to be determined to require power supply to the HDD 102 is not limited to a print job instructing the image forming apparatus 100 to perform printing.

On the other hand, there may be a case where, depending on the type of instruction data received from an external apparatus, the controller 200 completes the execution of the instruction data only by the CPU 211 and the RAM 213 mounted in the controller 200, and access to the HDD 102 is not needed. A specific example of instruction data requiring no power supply to the HDD 102 will be explained below.

The image forming apparatus 100 of the present embodiment can also accept commands requesting transmission of information on the state of the image forming apparatus 100 and of a processing result in the controller 200. For example, once the image forming apparatus 100 (NIC 350) receives a ping command of an ICMP protocol from the computer 170, the CPU 211 transmits a character string (ACK) indicating that the image forming apparatus 100 is in operation to the computer 170. Alternatively, in the event of receiving data conforming to an SSL/TSL protocol from the computer 170, the CPU 211 decodes the data and transmits such decoded data to the computer 170. In addition, counter values and user settings of the image forming apparatus 100 or the state of use of the print device 130 are included in the information on the state of the image forming apparatus 100. Since the image forming apparatus 100 only needs to read out and transmit the state information retained in the RAM 213, a command of requesting a response regarding the state information from a server (not shown) of the LAN 160 is also one of the instruction data that requires no power supply to the HDD 102.

As described above, the image forming apparatus 100 of the present embodiment determines whether data received in the power saving state is instruction data that requires power supply to the HDD, and if the instruction data is determined to require power supply, power is supplied to the HDD. Due to such a configuration, the image forming apparatus of the present embodiment can suppress wasteful power consumption and the wearing out of the storage device while reducing the period from the resume from sleep to the completion of printing.

Second Embodiment

Figure 7:
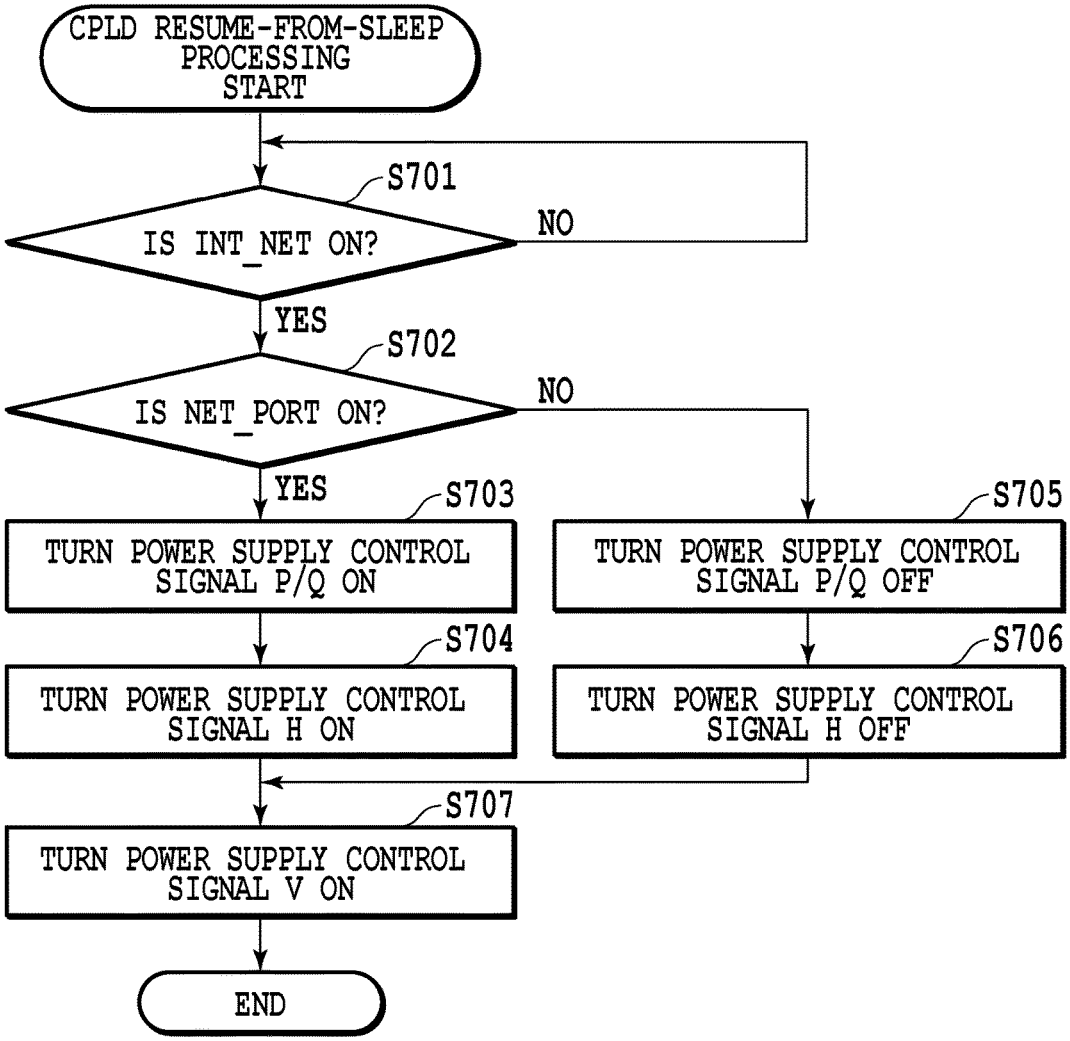
FIG. 7 is a flowchart showing steps of CPLD resume-from-sleep processing according to a second embodiment.

CPLD resume-from-sleep processing of the second embodiment will be explained with reference to the flowchart of FIG. 7. In the CPLD resume-from-sleep processing of the first embodiment, the CPLD 220 switches between power supply/non-supply to the HDD 102 in accordance with whether the NET_PORT 352 is turned on or off. The CPLD resume-from-sleep processing of the second embodiment differs from that of the first embodiment in that the CPLD 220 switches not only between power supply/non-supply to the HDD 102 but also between power supply/non-supply to the print device 130. The details will be explained below with reference to the flowchart of FIG. 7.

In S701, the CPLD 220 determines whether INT_NET 351 is turned on or off. In a case where the INT_NET 351 is on (YES in S701), the processing proceeds to S702. In a case where the INT_NET 351 is off (NO in S701), the processing of S701 is repeated.

In S702, the CPLD 220 determines whether the NET_PORT 352 is turned on or off. In a case where the NET_PORT 352 is on (YES in S702), the processing proceeds to S703. In S703, the CPLD 220 issues the IO signal P_ON 310 and the IO signal Q_ON 313, which are power supply control signals, and makes control so as to supply power to the print device 130.

Specifically, in response to the input of the IO signal P_ON 310, the relay switch 311 is switched. In response to the switching of the relay switch 311, power supply to a logic system of the print device 130 from the power source 301 is made via the power supply line 312, that is, a power supply line. Here, the logic system corresponds to a unit that serves control in the print device 130 such as the CPU 320 and the RAM 326. Similarly, in response to the input of the IO signal Q_ON 313, the relay switch 315 is switched. In response to the switching of the relay switch 315, power supply to a load system of the print device 130 from the power source 301 is made via the power supply line 316. Here, the load system corresponds to a unit that performs drive operation in the print device 130 such as drums D321, 322, 323, and 324, and a fan 325.

In S704, the CPLD 220 issues the IO signal H_ON 370, that is, a power supply control signal. In response to the input of the IO signal H_ON 370, the relay switch 371 is switched. In response to the switching of the relay switch 371, power supply is made from the power source 301 to the HDD 102 via the power supply line 372, that is, a power supply line.

On the other hand, in a case where the NET_PORT 352 is off (NO in S702), the processing proceeds to S705. In S705, the CPLD 220 keeps the IO signal P_ON 310 and the IO signal Q_ON 313, which are power supply control signals, in a halt state. As the IO signal P_ON 310 and the IO signal Q_ON 313 are in halt, the relay switches 311 and 315 do not change and thus power is not supplied from the power source 301 to the print device 130.

In S706, the CPLD 220 keeps the IO signal H_ON 370, which is the power supply control signal, in a halt state. As the IO signal H_ON 370 is in halt, the relay switch 371 does not change and thus power is not supplied from the power source 301 to the HDD 102.

In S707, regardless of the state of the NET_PORT 352, the CPLD 220 issues the IO signal V_ON 307, that is, a power supply control signal. In response to the input of the IO signal V_ON 307, the relay switch 308 is switched. In response to the switching of the relay switch 308, power supply is made from the power source 301 to the controller 200 via the power supply line 309, that is, a power supply line.

In the present embodiment as well, like the first embodiment, regardless of whether the NET_PORT 352 is turned on or off, power is constantly supplied to the HDD 102 as in a conventional manner. Since specific processing steps are identical to those of the first embodiment, an explanation will be omitted.

As described above, the image forming apparatus 100 of the present embodiment determines whether data received in the power saving state is instruction data that requires power supply to the HDD, and if the instruction data is determined to require power supply to the HDD, power is supplied to the HDD and the print device. Due to such a configuration, the image forming apparatus of the present embodiment promptly supplies power not only to the HDD but also to the print device at the time of resume from sleep, and accordingly, can reduce a period from the resume from sleep to the completion of printing a first page.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

The image forming apparatus of the present invention can suppress wasteful power consumption and the wearing out of the storage device while reducing the period from the resume from sleep to the completion of printing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-139384 filed Jul. 14, 2016, which is hereby incorporated by reference wherein in its entirety.

What is claimed is:

1. An image forming apparatus comprising:

a printing unit configured to print an image on a print medium based on image data;

a communicating unit configured to receive data from an external apparatus;

a controlling unit configured to process the data received by the communication unit;

a storing unit configured to store the image data; and a power controlling unit configured to (i) turn off the controlling unit and the storing unit, (ii) turn on the controlling unit based on predetermined wake data received by the communicating unit, and (iii) independent from turning on the controlling unit, turn on the storing unit based on a destination port number of the predetermined wake data.

2. The image forming apparatus according to claim 1, wherein the power controlling unit makes power supply at least to the storing unit and the printing unit in response to input of a signal that the power controlling unit receives from the communicating unit.

3. The image forming apparatus according to claim 1, wherein the communicating unit outputs a signal to the power controlling unit in a case where the data received from the external apparatus is data of a predetermined pattern, and the power controlling unit makes power supply to the controlling unit in response to input of the signal.

4. The image forming apparatus according to claim 1, wherein the data from the external apparatus is printing instruction data for providing a printing instruction to.

5. The image forming apparatus according to claim 4, wherein the image data generated based on the printing instruction data is stored in the storing unit to which power supply is made.

6. The image forming apparatus according to claim 1, wherein the communicating unit outputs a signal causing the power controlling unit to turn on the controlling unit in a case where a destination port number of the predetermined wake data is 9100 indicating a RAW port or 515 indicating an LPR port.

7. The image forming apparatus according to claim 1, wherein the printing unit has a load part and a logic part for controlling the load part, and the power controlling unit further makes power supply to the load part and the logic part in response to input of a signal received from the communicating unit.

8. The image forming apparatus according to claim 7, wherein the power controlling unit outputs a start signal to the logic part in response to input of the signal received from the communicating unit, and the logic part changes operation of the load part based on input or no input of the signal received from the communicating unit.

9. The image forming apparatus according to claim 8, wherein the load part includes a drum used at least for printing, and the logic part controls not to adjust temperature of the drum in a case where the signal received from the communicating unit is inputted.

10. The image forming apparatus according to claim 8, wherein the load part includes at least a fan used for exhausting heat, and the logic part controls not to rotate the fan in a case where the signal received from the communicating unit is inputted.

11. The image forming apparatus according to claim 1, further comprising:

a power supplying unit configured to supply power to the storing unit; and a switching unit located between the power supplying unit and the storing unit, wherein the power controlling unit turns on the switching unit in response to input of a signal received from the communicating unit.

12. The image forming apparatus according to claim 1, wherein the storing unit is a hard disk drive.

13. A power control method of an image forming apparatus, the image forming apparatus including:

a printing unit configured to print an image on a print medium based on image data;

a communicating unit configured to receive data from an external apparatus;

a controlling unit configured to process the data received by the communication unit;

a storing unit configured to store the image data; and a power controlling unit configured to turn on and off the controlling unit and configured to turn on and off the storing unit, the power control method comprising the steps of:

turning on the controlling unit based on predetermined wake data received by the communicating unit; and turning on the storing unit, independent from turning on the controlling unit, based on a destination port number of the predetermined wake data.

14. A non-transitory computer readable storage medium storing a program for causing a computer to function as an image forming apparatus, wherein the image forming apparatus comprises:

a printing unit configured to print an image on a print medium based on image data;

a communicating unit configured to receive data from an external apparatus;

a controlling unit configured to control the image forming apparatus process the data received by the communicating unit;

a storing unit configured to store the image data; and a power controlling unit configured to turn on and off the controlling unit and configured to turn on and off the storing unit, wherein the power control unit turns on the controlling unit based on predetermined wake data received by the communicating unit; and wherein the power control unit turns on the storing unit, independent from turning on the controlling unit, based on a destination port number of the predetermined wake data.

* * * * *